US009222746B2

(12) United States Patent
Doll et al.

(10) Patent No.: US 9,222,746 B2
(45) Date of Patent: Dec. 29, 2015

(54) TRIGGER ASSEMBLY FOR A FIRE ARM

(71) Applicant: Heckler & Koch GmbH, Oberndorf (DE)

(72) Inventors: Stefan Doll, Oberndorf (DE); Gerhard Gielke, Oberndorf (DE); Stefan Thimm, Hardt (DE); Francesco Beninato, Oberndorf (DE)

(73) Assignee: HECKLER & KOCH GMBH, Oberndorf (DE)

( * ) Notice: Subject to any disclaimer, the term of this patent is extended or adjusted under 35 U.S.C. 154(b) by 0 days.

(21) Appl. No.: 14/412,705

(22) PCT Filed: Jun. 18, 2013

(86) PCT No.: PCT/EP2013/062556

§ 371 (c)(1),
(2) Date: Jan. 5, 2015

(87) PCT Pub. No.: WO2014/012727

PCT Pub. Date: Jan. 23, 2014

(65) Prior Publication Data

US 2015/0168091 A1 Jun. 18, 2015

(30) Foreign Application Priority Data

Jul. 16, 2012 (DE) ..... 10 2012 212 388

(51) Int. Cl.
*F41A 19/06* (2006.01)
*F41A 19/26* (2006.01)
(Continued)

(52) U.S. Cl.
CPC ..... *F41A 19/06* (2013.01); *F41A 17/46* (2013.01); *F41A 19/26* (2013.01); *F41A 17/58* (2013.01); *F41A 19/32* (2013.01)

(58) Field of Classification Search
CPC ..... F41A 19/00; F41A 19/04; F41A 19/09; F41A 19/10; F41A 19/12; F41A 19/24; F41A 19/25; F41A 19/26; F41A 19/31; F41A 19/13; F41A 19/32; F41A 17/46; F41A 17/58
USPC ..... 42/14, 69.02; 89/136, 145, 130, 143, 89/144, 180, 181
See application file for complete search history.

(56) References Cited

U.S. PATENT DOCUMENTS 1,150,610 A * 8/1915 Mauser ..... F41A 19/31 42/70.06
2,125,350 A * 8/1938 Loomis ..... F41A 3/68 42/18

(Continued)

FOREIGN PATENT DOCUMENTS

DE 1453917 A 9/1969
DE 1703157 A 12/1971

(Continued)

*Primary Examiner* — Bret Hayes
*Assistant Examiner* — Derrick Morgan
(74) *Attorney, Agent, or Firm* — Leydig, Voit & Mayer, Ltd.

(57) ABSTRACT

A trigger assembly for a fire arm including a breechblock moving between a base position and a charging position. The trigger assembly includes a catch lever moving between a resting position and a catch position. The trigger assembly includes a trigger element moving between a non-actuation and an actuation position to transfer the catch lever from the catch position into the resting position, and a release element moving between a hold position and a release position for releasing the catch lever. The release element is transferred from the hold position into the release position by the breechblock moving toward the charging position. The release element pivots about a release-element axis movable relative to the trigger element so the release element in the non-actuation position moves out of a movement space of the breechblock when the trigger is secured via a breechblock moving towards the base position.

12 Claims, 9 Drawing Sheets

(51) Int. Cl.

| | |
|---|---|
| ***F41A 17/46*** | (2006.01) |
| *F41A 17/58* | (2006.01) |
| *F41A 19/32* | (2006.01) |

(56) References Cited

U.S. PATENT DOCUMENTS

| | | | | | |
|---|---|---|---|---|---|
| 2,365,440 | A * | 12/1944 | Seitz | F41A 17/20 | 42/69.02 |
| 2,654,175 | A * | 10/1953 | Hansen | F41A 19/24 | 42/69.03 |
| 3,027,811 | A * | 4/1962 | Young | F41A 19/32 | 42/69.02 |
| 3,478,644 | A * | 11/1969 | Cermak | F41A 19/46 | 89/140 |
| 3,695,143 | A * | 10/1972 | Frix | F41A 19/32 | 89/145 |
| 3,950,876 | A * | 4/1976 | Wild | F41A 19/32 | 42/69.01 |
| 4,133,128 | A * | 1/1979 | Brush | F41A 17/42 | 42/701.01 |
| 5,363,581 | A * | 11/1994 | Blenk | F41A 19/31 | 42/69.02 |
| 5,770,814 | A * | 6/1998 | Ealovega | F41A 19/04 | 89/131 |
| 5,852,891 | A * | 12/1998 | Onishi | F41A 19/17 | 42/69.01 |
| 5,913,261 | A | 6/1999 | Guhring et al. | | |
| 7,398,723 | B1 * | 7/2008 | Blakley | F41A 19/12 | 42/69.01 |
| 8,910,621 | B2 * | 12/2014 | Arnedo | F41A 19/59 | 124/31 |
| 2004/0194615 | A1 * | 10/2004 | Gablowski | F41A 17/32 | 89/148 |
| 2007/0180748 | A1 * | 8/2007 | Zemanek | F41A 3/40 | 42/69.02 |
| 2009/0107024 | A1 * | 4/2009 | Doll | F41A 17/42 | 42/70.01 |
| 2010/0257769 | A1 * | 10/2010 | Doll | F41A 17/56 | 42/69.02 |
| 2011/0168008 | A1 * | 7/2011 | Landies | F41A 19/10 | 89/128 |
| 2011/0185615 | A1 * | 8/2011 | Gangl | F41A 17/46 | 42/69.01 |
| 2012/0090213 | A1 * | 4/2012 | Pichler | F41A 17/46 | 42/70.06 |
| 2012/0096753 | A1 * | 4/2012 | Pichler | F41A 19/12 | 42/69.01 |
| 2013/0263840 | A1 * | 10/2013 | Maeda | F41B 11/721 | 124/76 |
| 2015/0007804 | A1 * | 1/2015 | Trippmann, Jr. | F41B 11/722 | 124/73 |

FOREIGN PATENT DOCUMENTS

| | | | |
|---|---|---|---|
| DE | 2249319 | A | 4/1974 |
| DE | 3623055 | A1 | 1/1988 |
| DE | 19626077 | A1 | 1/1998 |
| DE | 19643377 | C2 | 7/2000 |
| DE | 10163003 | A | 7/2003 |
| DE | 102007052105 | B | 5/2009 |

* cited by examiner

TRIGGER ASSEMBLY FOR A FIRE ARM

CROSS-REFERENCE TO RELATED APPLICATIONS

This application is a U.S. National Phase application under 35 U.S.C. §371 of International Application No. PCT/EP2013/062556, filed on Jun. 18, 2013, and claims benefit to German Patent Application No. DE 10 2012 212 388.1, filed on Jul. 16, 2012. The International Application was published in German on Jan. 23, 2014, as WO 2014/012727 A1 under PCT Article 21 (2).

FIELD

The invention relates to a trigger assembly for a fire arm, comprising a breechblock which can be moved between a base position and a charging position, a catch lever which can be moved between a resting position for releasing the breechblock and a catch position for catching the breechblock, a trigger element that can be moved between a non-actuation position and an actuation position, in order to transfer the catch lever from the catch position thereof into the resting position thereof, a release element that can be moved relative to the trigger element, which release element can be moved between a hold position for holding the catch lever in the resting position thereof and a release position for releasing a movement of the catch lever in the catch position thereof, the release element being transferred from the hold position thereof into the release position by a contact of the breechblock moving in the direction of the charging position with the release element.

BACKGROUND

Trigger assemblies for a rapid-fire weapon are known from DE 101 63 003 A1 and from DE 10 2007 052 105 B3. The aim of the release element is for the catch lever to assume a defined position, i.e. either a resting position in which the breechblock can be moved, unimpeded by the catch lever, in the direction of the cartridge chamber (base position), or a catch position in which the catch lever prevents the breechblock from moving in the direction of the base position. The release element is preferably held in the hold position by means of a spring, and can be transferred into the release position counter to the action of the spring.

If, in a weapon of the above-mentioned type when the weapon is secured, the breechblock is moved out of the base position into an intermediate position in which the catch lever which is in the catch position is not yet engaged with the breechblock, a movement of the breechblock starting from the intermediate position in the direction of the base position results in the breechblock running onto the release element with a catch element of the bolt carrier and blocking there in an intermediate position.

If, in the case of a (secured or unsecured) weapon of the above-mentioned type, the breechblock is moved out of the base position into the charging position, in which the catch lever which is in the catch position prevents the breechblock from moving in the direction of the base position, a manipulation of the weapon (manual holding of the breechblock in the charging position, (if secured) releasing the safety of the weapon, pulling of the trigger element, releasing of the trigger element, re-securing) results in the release element which moves with the trigger element backing the catch lever, and in the hold position of the release element holding the catch lever in the resting position thereof. The catch lever then remains in its resting position, so that the breechblock can be moved in the direction of the base position. A movement of the breechblock starting from the charging position in the direction of the base position under these circumstances however again results in the breechblock running onto the release element and blocking there on the foremost sear catch of the breechblock.

SUMMARY

In an embodiment, the present invention provides a trigger assembly for a fire arm including a breechblock moving between a base position and a charging position. The trigger assembly includes a catch lever moving between a resting position and a catch position. The trigger assembly includes a trigger element moving between a non-actuation and an actuation position to transfer the catch lever from the catch position into the resting position, and a release element moving between a hold position and a release position for releasing the catch lever. The release element is transferred from the hold position into the release position by the breechblock moving toward the charging position. The release element pivots about a release-element axis movable relative to the trigger element so the release element in the non-actuation position moves out of a movement space of the breechblock when the trigger is secured via a breechblock moving towards the base position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
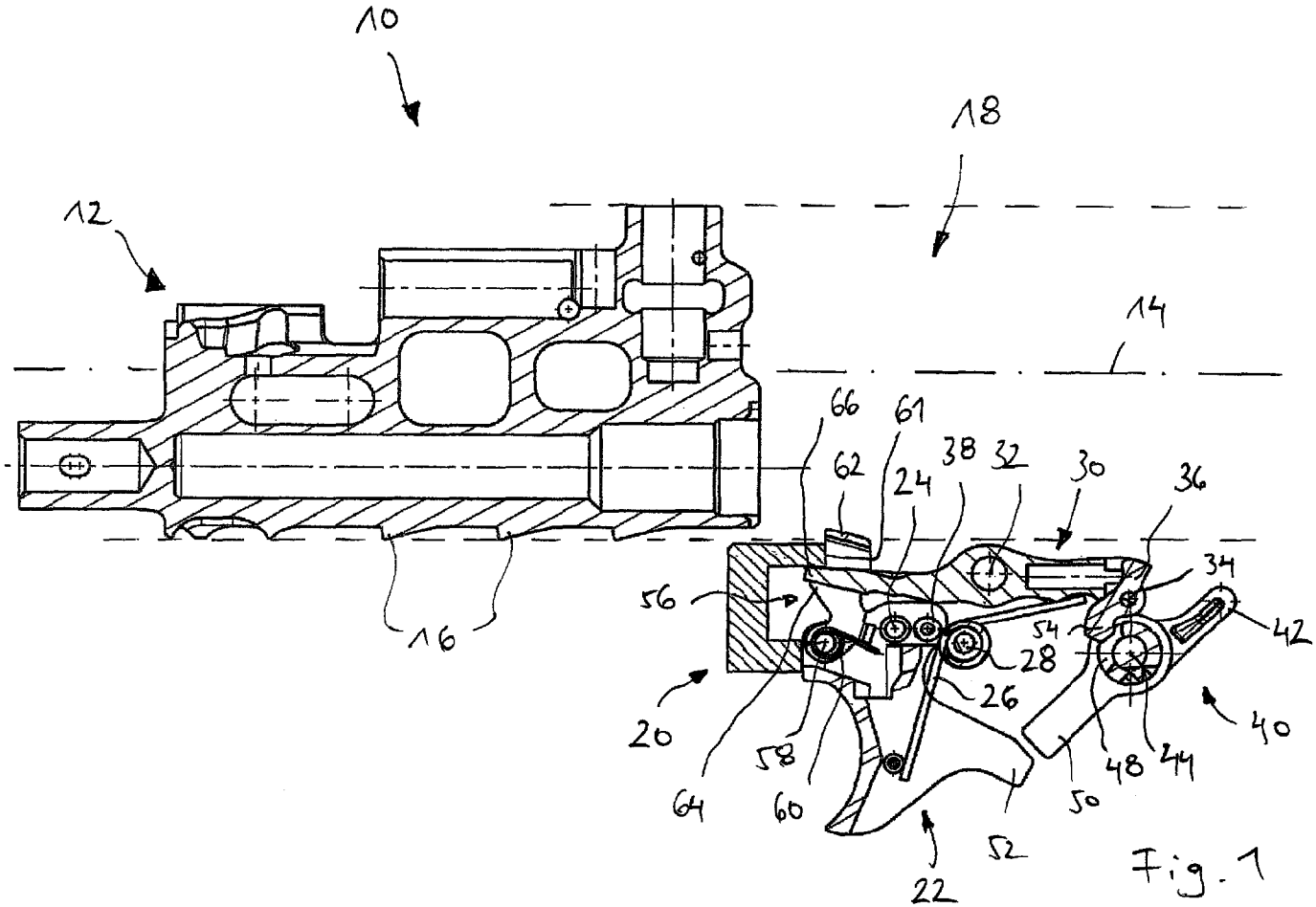
FIG. 1 is a side view of a trigger assembly known from the prior art, with a breechblock in a base position.

An aspect of the present invention is to improve a trigger assembly such that blocking of a breechblock which is moving in the direction of the base position by the release element when the trigger is secured is prevented.

This aspect is achieved according to the invention in a trigger assembly referred to first hereinbefore in that the release element can be pivoted about a release-element pivoting axis which is movable relative to the trigger element, so that the release element in the non-actuation position of the trigger element can be moved out of a movement space of the breechblock even when the trigger is secured, by means of a breechblock which moves in the direction of the base position.

In the trigger assembly according to the invention, provision is made for the release element to be able to be pivoted about a release-element pivoting axis, the position of this pivoting axis being able to be moved relative to the trigger element. This provides an additional degree of freedom for the movement of the release element, so that after a manipulation of the weapon as described first hereinbefore a movement of the breechblock in the direction of the base position when the trigger is secured is no longer accompanied by blocking of the breechblock with the release element. Rather, it is now possible for the breechblock which is moving in the direction of the base position to subject the release element to a contact force and in this manner to displace the release-element pivoting axis, so that a section of the release element which originally protrudes into the movement space of the breechblock moves into a position outside the movement space.

The movement of the release element out of the movement space of the breechblock takes place advantageously substantially perpendicular to the axis of movement of the breechblock. The operation of the release element moving out of the way can also be described by the term "descent".

In an advantageous embodiment of the invention, provision is made for the release-element pivoting axis to be arranged on an additional element which is separate from the release element and the trigger element, and for the additional element to be mounted so as to be movable relative to the trigger element. This means that the movability of the release-element pivoting axis relative to the trigger element can be achieved in a manner which is simple in terms of design.

Advantageously, the additional element is mounted in the trigger element to be pivotable about an additional-element pivoting axis, so that a relative movement of the additional element relative to the trigger element is accompanied by pivoting of the additional element. This has the advantage that the space available within the trigger element can be used for a movement of the additional element relative to the trigger element.

Further, it is preferred if the release-element pivoting axis and the additional-element pivoting axis are parallel to one another, in particular colinear with one another. In this manner, a compact arrangement can be provided in which the release element can be pivoted relative to the additional element, and the additional element relative to the trigger element. "Descent" of the release element as described above is then accompanied by pivoting of the additional element about the additional-element pivoting axis, with the trigger element remaining in an in particular secured non-actuation position.

Advantageously, the trigger assembly comprises a safety means, which in a secured state secures the catch lever in the catch position thereof and the trigger element in the non-actuation position thereof, and in an unsecured state permits transfer of the catch lever into the resting position thereof and transfer of the trigger element into the actuation position thereof.

In a particularly advantageous embodiment, the safety means has a safety element which is coupled in terms of movement with the release element in such a way that transfer of the safety means out of the unsecured state into the secured state is compulsorily accompanied by transfer of the release element out of the hold position thereof into the release position. This has the advantage that a catch lever which is subjected to force by a trigger spring, accompanied by securing of the fire arm, is compulsorily transferred into the catch position. In the case of a manipulation of the weapon which is described first hereinbefore (manual holding of the breechblock in the charging position, unsecuring of the weapon, pulling of the trigger element, re-securing), the catch lever is automatically transferred into its hold position. By means of the safety element, it is now possible that after the trigger element has been transferred into the non-actuation position thereof securing of the weapon is not accompanied by the catch lever remaining in its resting position, but instead of this being transferred automatically into the catch position.

A compact and reliable design arises if the safety element can be pivoted about a safety-element pivoting axis.

A particularly compact construction arises if the safety-element pivoting axis is parallel, in particular colinear, to a bearing axis of a trigger spring which serves to subject the catch lever to a spring force.

Further, it is preferable if the safety means comprises an operating element, which can be pivoted about an operating axis, in order to transfer the safety element into the secured or non-secured state thereof, and if the operating element and the safety element are coupled together in terms of movement by means of a turning and sliding joint. This permits reliable transfer of a pivoting movement of the operating element to a pivotably mounted safety element.

The invention furthermore relates to a fire arm, in particular a handgun, which comprises a trigger assembly as described above.

Further features and advantages of the invention are the subject of the following description and the graphical representation of preferred embodiments.

Figure 3:
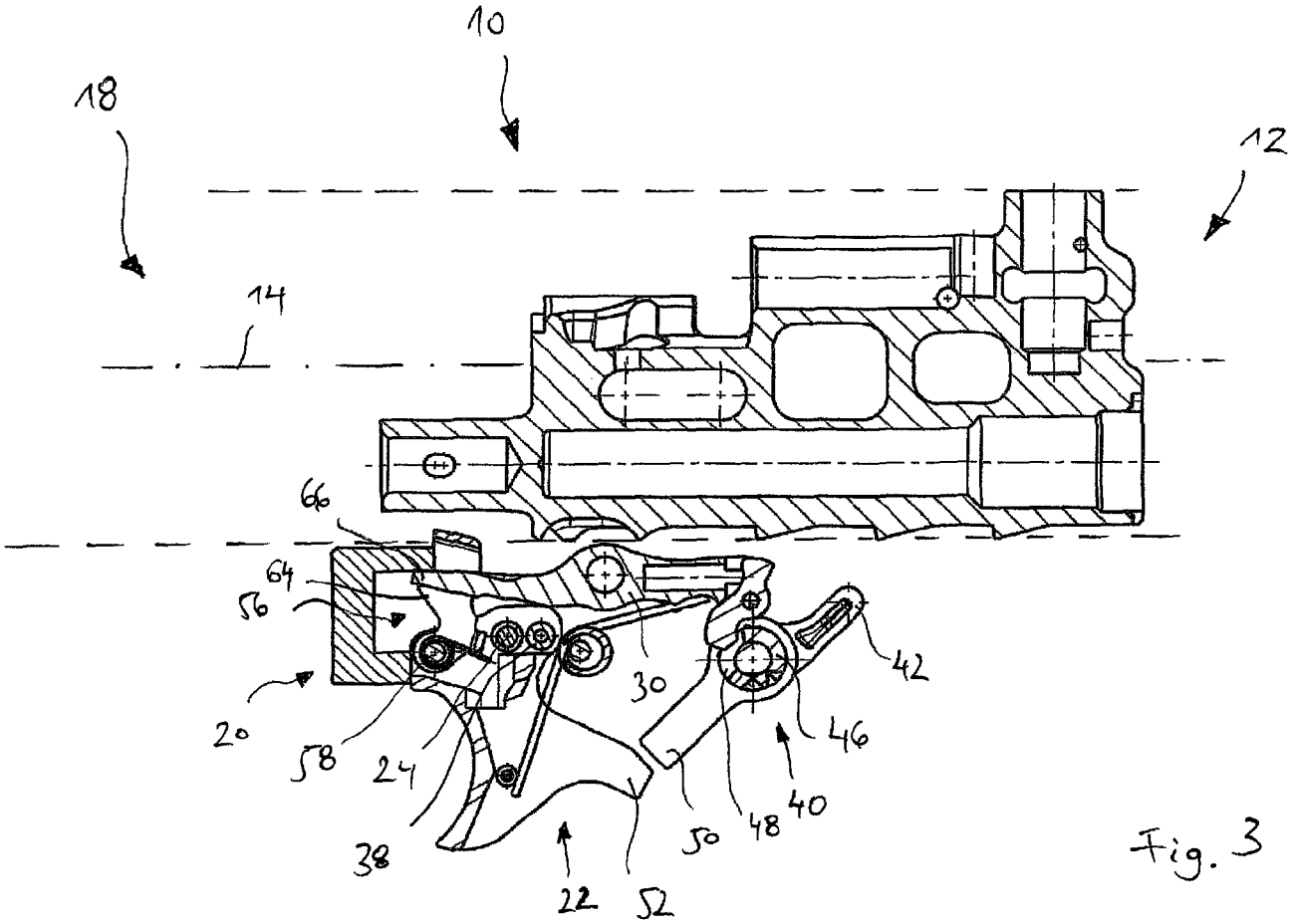
FIG. 3 is a view corresponding to FIG. 1 upon manipulation of the trigger assembly, with a breechblock held manually in its charging position after unsecuring, actuation of the trigger and re-securing.

A trigger assembly 10 illustrated in the drawings comprises a breechblock 12 which can be moved along a centre line 14 between a base position (cf. FIG. 1) and a charging position (cf. FIG. 3). The breechblock 12 has on its underside a plurality of sear catches 16 which are arranged one behind another when viewed along the centre line 14.

The breechblock 12 occupies a movement space 18 which is indicated in the drawing by broken lines which are parallel to one another. The breechblock 12 can be acted upon in the direction of firing by a recoil spring which is known per se and is therefore not illustrated.

The trigger assembly 10 further comprises a grip piece 20, on which a trigger element 22 is mounted pivotably about a trigger-element pivoting axis 24. The trigger element 22 is held in a non-actuation position by means of a trigger spring 26. The trigger spring 26 is in the form of a leg spring which is mounted on a transverse pin 28. The transverse pin 28 is fastened to the grip piece 20.

The trigger spring 26 furthermore cooperates with a catch lever 30 which is mounted on the grip piece 20 to be pivotable about a catch-lever pivoting axis 32. The catch lever 30 has on its rearward end a safety pawl 36 which is pivotably mounted on a spindle 34.

The catch lever 30 can assume a resting position in which the safety pawl 36 is located outside the movement space 18 of the breechblock 12 (cf. FIG. 1). The catch lever 30 can furthermore assume a catch position in which the safety pawl 36 of the catch lever 30 protrudes into the movement space 18 of the breechblock 12, in order to catch the breechblock 12 on the sear catch 16 thereof and to prevent it from a movement in the direction of the base position.

The trigger element 22 has a release roller 38 which together with the trigger element 22 can be pivoted about the trigger-element pivoting axis 24. In an unsecured state of the trigger assembly 10, the trigger element 22, starting from the non-actuation position illustrated for example in FIG. 2, can be pivoted counter to the action of the trigger spring 26 rearwards into an actuation position, so that the release roller 38 presses against an underside of the catch lever 30 and transfers the latter, counter to the action of the trigger spring 26, out of the catch position illustrated in FIG. 2 into the resting position illustrated in FIG. 1.

The trigger assembly 10 further comprises a safety means which is designated as a whole by the reference numeral 40. This comprises a manually operated operating element 42 which can be pivoted about an operating axis 44. The operating element 42 is connected in rotation-resistant manner to a safety roller 46, which has a safety-pawl recess 48. The safety means 40 further comprises a safety section 50 which can be pivoted with the operating element 42, which section cooperates with a rearward section 52 of the trigger element 22.

In the secured state of the safety means 40, the safety section 50 prevents pivoting of the trigger element 22 about the trigger-element pivoting axis 24. Further, the safety roller 46, in the catch position of the catch lever 30 and when a sear catch 16 of the breechblock 12 is lying against the safety pawl 36 (cf. FIG. 9), prevents a lower safety-pawl section 54 of the safety pawl 36 from dipping into the safety-pawl recess 48 of the safety roller 46. In this manner, the safety means 40 secures the catch lever 30 in the catch position thereof when the breechblock is caught.

The trigger assembly 10 further comprises a release element 56, which can be pivoted about a release-element pivoting axis 58. The release element 56 is subjected to force by means of a release-element spring 60, so that the release element 56 in a hold position presses against a stop 61 of the grip piece 20. In this hold position, a release pawl 62 of the release element 56 protrudes into the movement space 18 of the breechblock 12.

The release element 56 further has a catch projection 64 which serves to back a contact section 66 of the catch lever 30. The contact section 66 extends perpendicular to the plane of the drawing. In the resting position of the catch lever 30, the release element 56 holds the catch lever 30 by the catch projection 64 of the release element 56 backing the contact section 66 (cf. FIG. 1).

Figure 2:
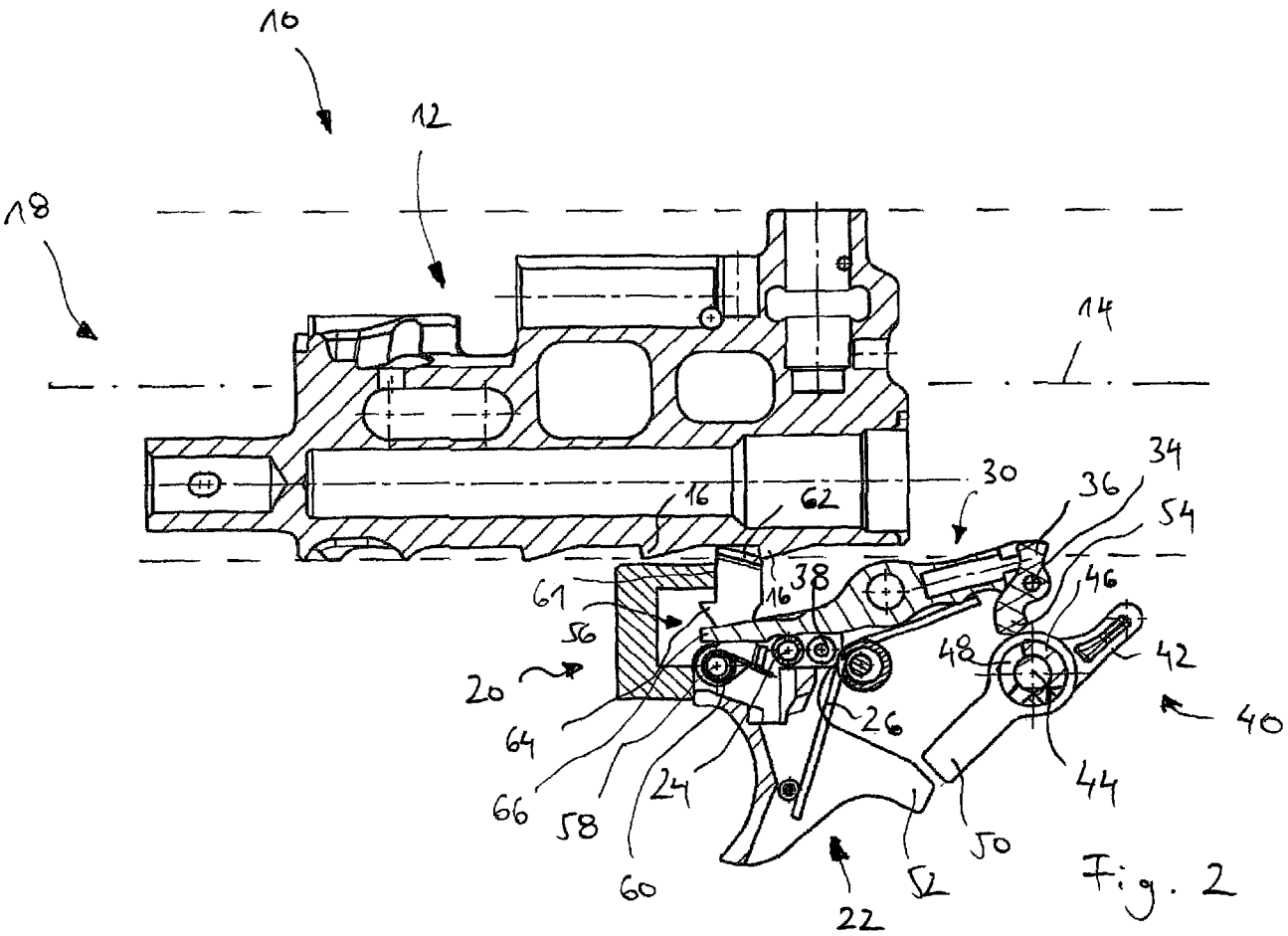
FIG. 2 is a view corresponding to FIG. 1, with the breechblock in a blocked intermediate position (breechblock, not completely drawn back and released again, with secured trigger)

If, in the trigger assembly 10 illustrated in FIG. 1, the breechblock 12 moves out of the base position in the direction of the charging position and assumes for example an intermediate position illustrated in FIG. 2, the rear side of the breechblock 12 and the sear catches 16 pass over the release pawl 62, so that the release element 56 is moved about the release-element pivoting axis 58 rearwards and out of the movement space 18 of the breechblock 12 into a release position. In the release position of the release element 56, the catch projection 64 of the release element 56 is no longer engaged with the contact section 66 of the catch lever 30, so that the latter is transferred out of its resting position (cf. FIG. 1) into its catch position (cf. FIG. 2) by means of the trigger spring 26.

If, starting from the intermediate position of the breechblock 12 illustrated in FIG. 2, said breechblock is to be moved forwards in the direction of the base position while the trigger is secured (cf. FIG. 1), a sear catch 16 which is arranged behind the release pawl 62 in the direction of firing blocks on the release pawl 62, since the release element 56 lies against the stop 61 of the grip piece 20. Since the rearward section 52 of the trigger element 22 is also backed by the safety section 50 of the safety means 40, the trigger element 22 and the release element 56 which is mounted securely therein cannot move out of the way.

Such blocking may also occur in the charged state of the trigger assembly 10 (cf. FIGS. 3 and 4); if the breechblock 12 is in the charging position illustrated in FIG. 3 and the catch lever 30 adopts a catch position (cf. FIG. 9), the safety means 40 in its secured state causes the trigger element 22 not to be movable out of a non-actuation position into an actuation position, since the rearward section 52 of the trigger element 22 presses against the safety section 50 of the safety means 40. Further, the safety roller 46 prevents the lower section 54 of the safety pawl 36 from dipping into the safety-pawl recess 48. If now the breechblock is held by hand and the safety means 40 is transferred into its unsecured state, the trigger element 22 can be pivoted about the trigger-element pivoting axis 24, so that the release roller 38 presses against the underside of the catch lever 30 and transfers the catch lever out of the catch position into the resting position illustrated in FIG. 3, in which the catch projection 64 of the release element 56 backs the contact section 66 of the catch lever 30.

If now the trigger element 22 is transferred back into its non-actuation position, i.e. the trigger element 22 is released, the catch lever 30 remains in the resting position illustrated in FIG. 3. If then the safety means 40 is transferred out of the unsecured state into the secured state illustrated in FIG. 3, then although the trigger element 22 is prevented from moving into an actuation position, the catch lever 30 is in its resting position. If now the breechblock 12 which is held by hand is released, the recoil spring brings about a movement of the breechblock 12, starting from the charging position illustrated in FIG. 3, forwards in the direction of the base position. In this case, a sear catch 16 of the breechblock 12 which is arranged at the front in the direction of firing comes into blocking engagement with the release pawl 62, which protrudes into the movement space 18 of the breechblock 12 and is blocked as a result of the release element 56 lying against the stop 61 of the grip piece 20.

Figure 4:
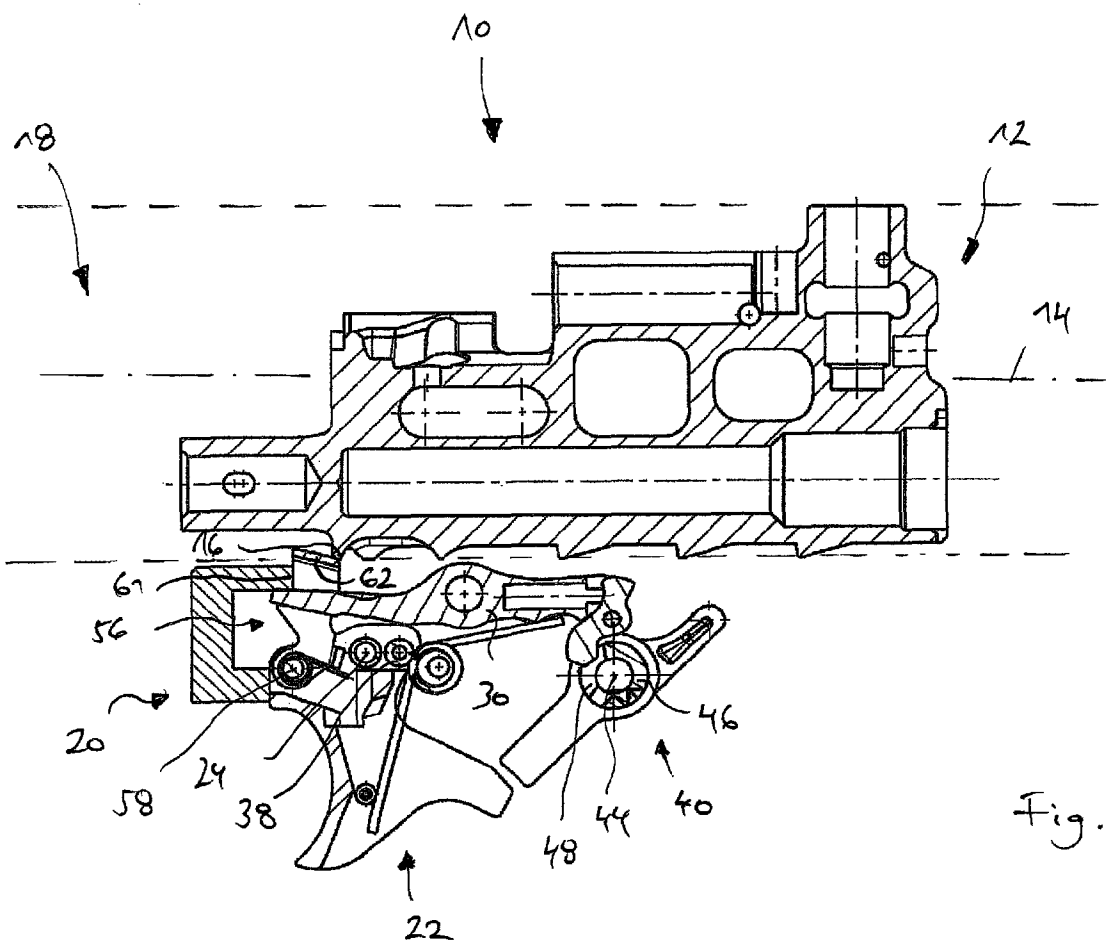
FIG. 4 is a view corresponding to FIG. 3, with the released breechblock in a blocked charging position.

If now, starting from the blocking position of the trigger assembly 10 illustrated in FIG. 4, the safety means 40 is unsecured, a shot can be fired unintentionally by the release pawl 62 descending without the trigger element 22 being actuated.

Figure 5:
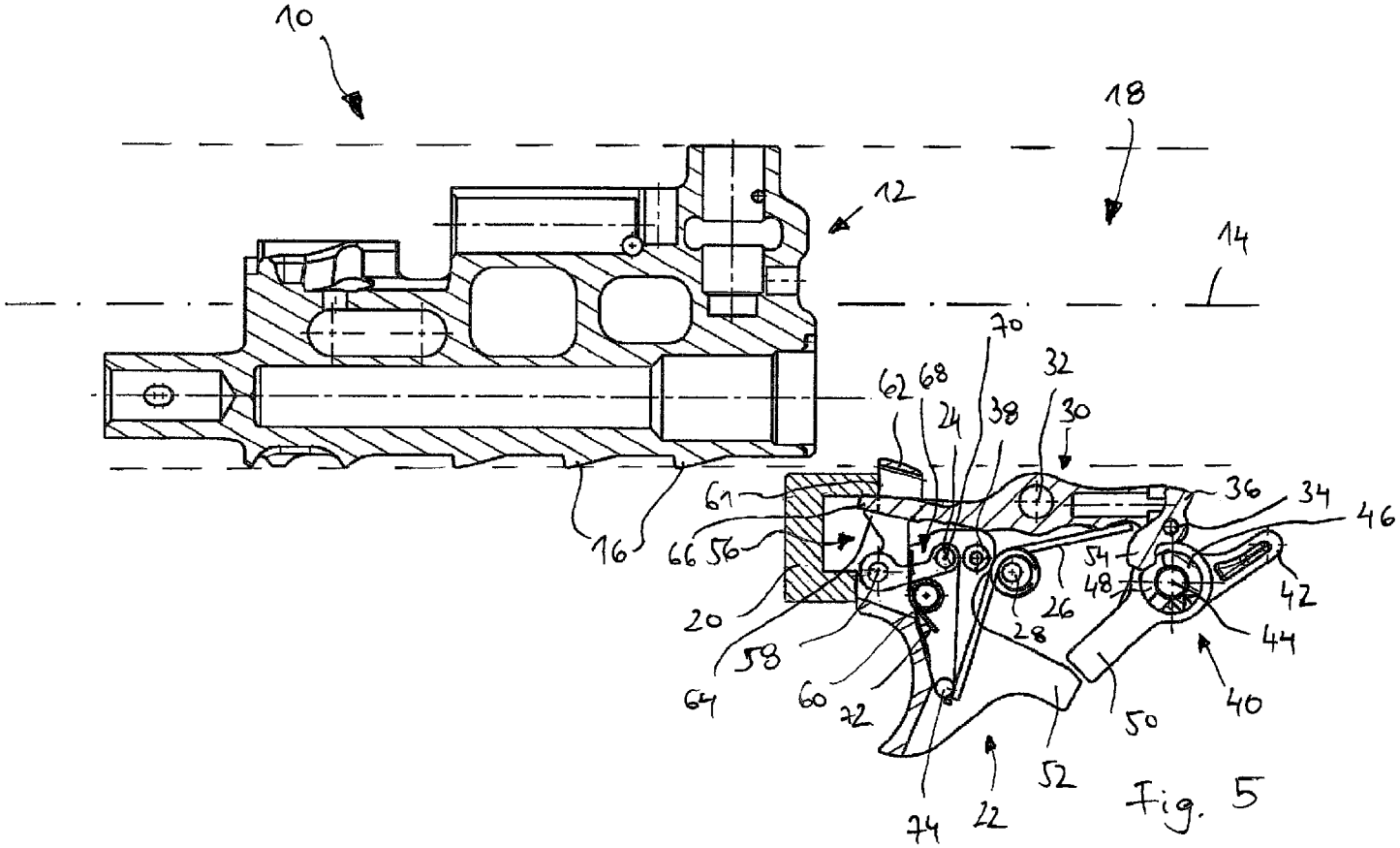
FIG. 5 is a side view of an embodiment of a trigger assembly according to the invention, with a breechblock in a base position.
Figure 6:
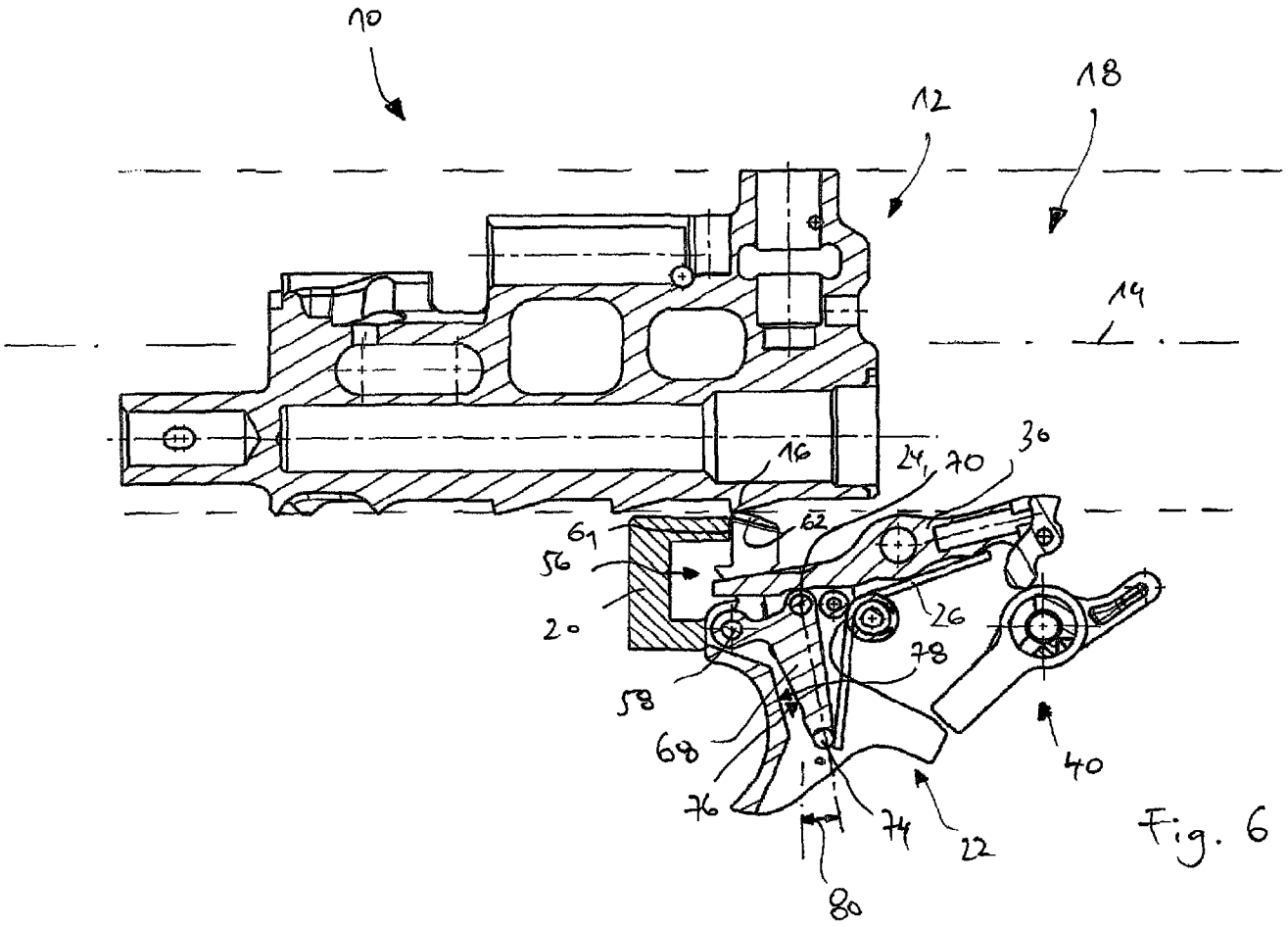
FIG. 6 is a view corresponding to FIG. 5, with the breechblock not completely drawn back and moving forward again, which with its rearmost safety catch is just running over a release element which is moving out of the way downwards.
Figure 7:
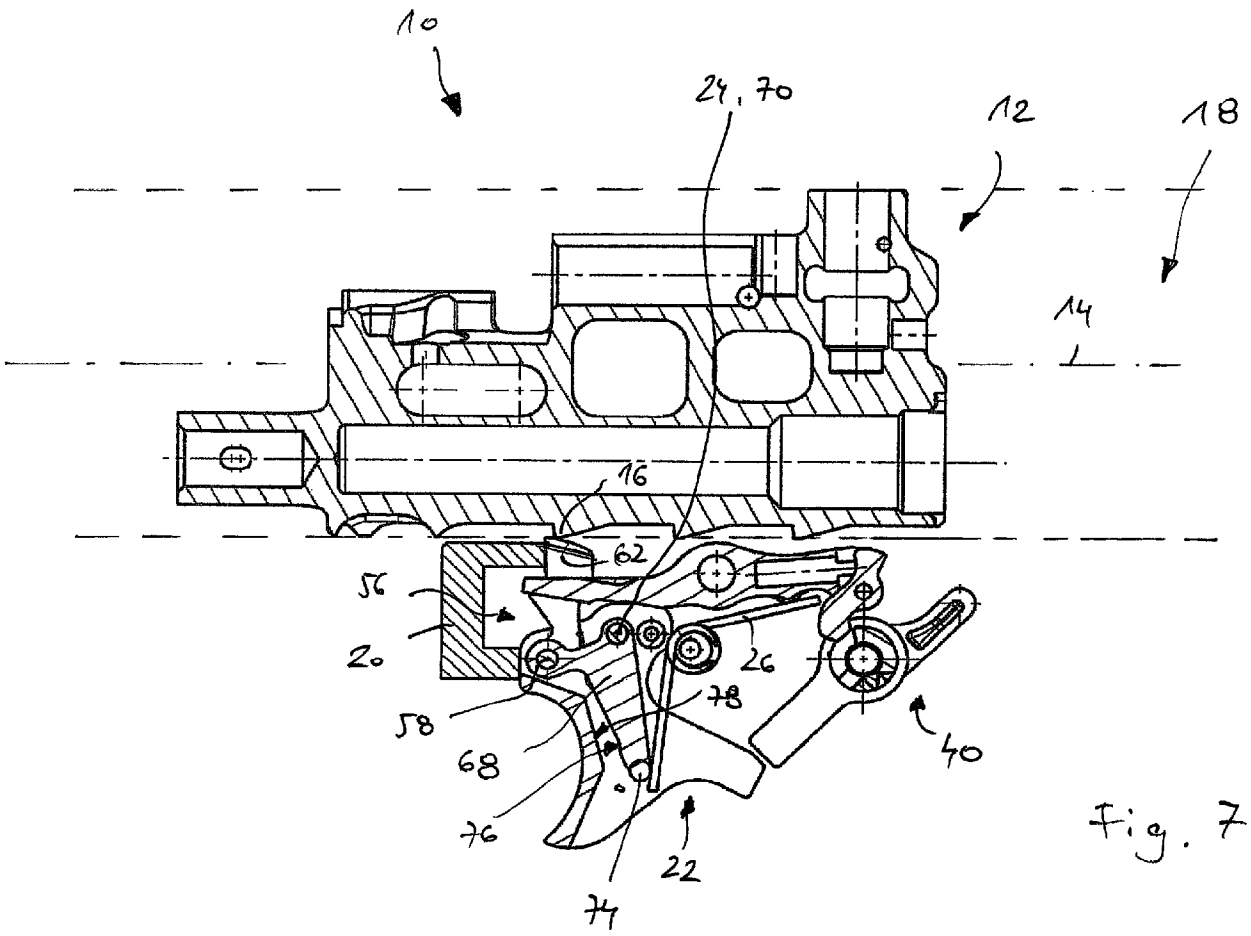
FIG. 7 is a view corresponding to FIG. 5, in which the breechblock, which is held manually in its catch position and is released again after unsecuring, actuation and securing of the trigger assembly, with its main sear catch is just running over the release element which moves out of the way downwards.

A trigger assembly 10 illustrated in FIGS. 5 to 7 has a construction comparable to the trigger assembly 10 described above with reference to FIGS. 1 to 4. Therefore, reference will also be made to the above description for the description of the construction and the method of operation of the trigger assembly 10 according to FIGS. 5 to 7.

In the trigger assembly 10 according to FIGS. 5 to 7, the release-element pivoting axis 58 is not fixed to the trigger element 22. Rather, the release-element pivoting axis 58 is movable relative to the trigger element 22.

The release-element pivoting axis 58 is mounted on an additional element 68 which can be pivoted about an additional-element pivoting axis 70.

The additional-element pivoting axis 70 is colinear and preferably identical to the trigger-element pivoting axis 24 of the trigger element 22. In one structural realisation of the pivoting axes 24 and 70, for example a pin fastened to the grip piece 20 is provided, about which both the trigger element 22 and the additional element 68 can be pivoted.

The release-element pivoting axis 58 is arranged in front of the additional-element pivoting axis 70 in the direction of firing. Pivoting of the additional element 68 about the additional-element pivoting axis 70 thus brings about displacement of the release-element pivoting axis 58 in a direction transverse to the centre line 14 of the breechblock 12.

The release-element spring 60, which subjects the release element 56 to a restoring force, is supported on the additional element 68, in particular on a spring stop surface 72 of the additional element 68.

The trigger spring 26, which at one end acts on the catch lever 30, is supported at the other end on a trigger-spring contact section 74 which is connected securely to the additional element 68 or is formed in one piece therewith.

The additional element 68 has a supporting surface 76 which cooperates with a grip piece surface 78 (cf. FIG. 6).

The additional element 68 can be pivoted between an initial position illustrated in FIG. 5 and a pivot position illustrated in FIG. 6.

In the initial position illustrated in FIG. 5, the trigger spring 26 presses against the trigger-spring contact section 74 of the additional element 68, so that the latter lies with its supporting surface 76 against the grip piece surface 78. Furthermore, the release-element spring 60 causes the release element 56 in its hold position to lie against the stop 61.

A pivot angle 80 measured between the initial position and the pivot position of the additional element 68 is preferably relatively small, and is for example approximately 10° to approximately 20°.

If the breechblock 12 of the trigger assembly 10 is in an intermediate position illustrated in FIG. 6, a movement of the breechblock 12 in the direction of the base position no longer results in the sear catch 16 blocking with the release pawl 62. The release pawl 62 can be transferred out of its position illustrated in FIG. 5, in which it protrudes into the movement space 18 of the breechblock 12, into an out-of-the-way position, in which the release element 56 lies against the stop 61 of the grip piece 20, but moves away from the sear catch 16 in a direction substantially transverse to the centre line 14 of the breechblock 12, namely by pivoting the additional element 68 out of its initial position (cf. FIG. 5) into the pivot position (cf. FIG. 6).

In so doing, the sear catch 16 presses on the release pawl 62, as a result of which the release-element pivoting axis 58 moves out of the way downwards, as a result of which the additional element 68 is pivoted about the additional-element pivoting axis 70. In so doing, the supporting surface 76 detaches itself from the grip piece surface 78. Furthermore, the trigger spring 26 is deformed. Owing to the pivotability of the additional element 68, it is possible for the release pawl 62 to move out of the way even when the weapon is secured.

It is also possible for the release element 56 to move out of the way as described above when the breechblock 12, starting from a charging position, moves in the direction of the base position (cf. FIG. 7).

Figure 8:
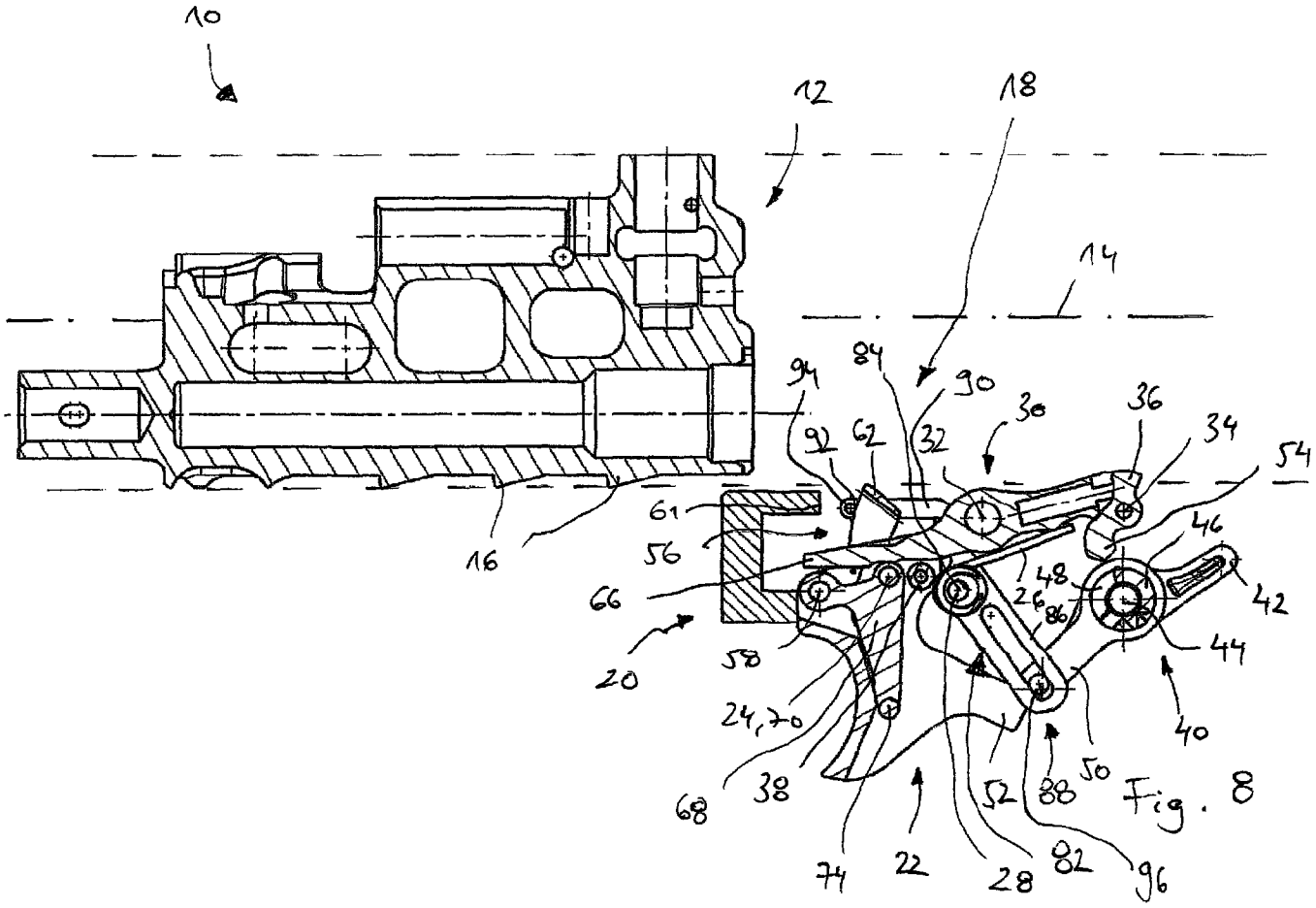
FIG. 8 is a side view of a further embodiment of a trigger assembly according to the invention, with secured trigger and breechblock in the base position.
Figure 9:
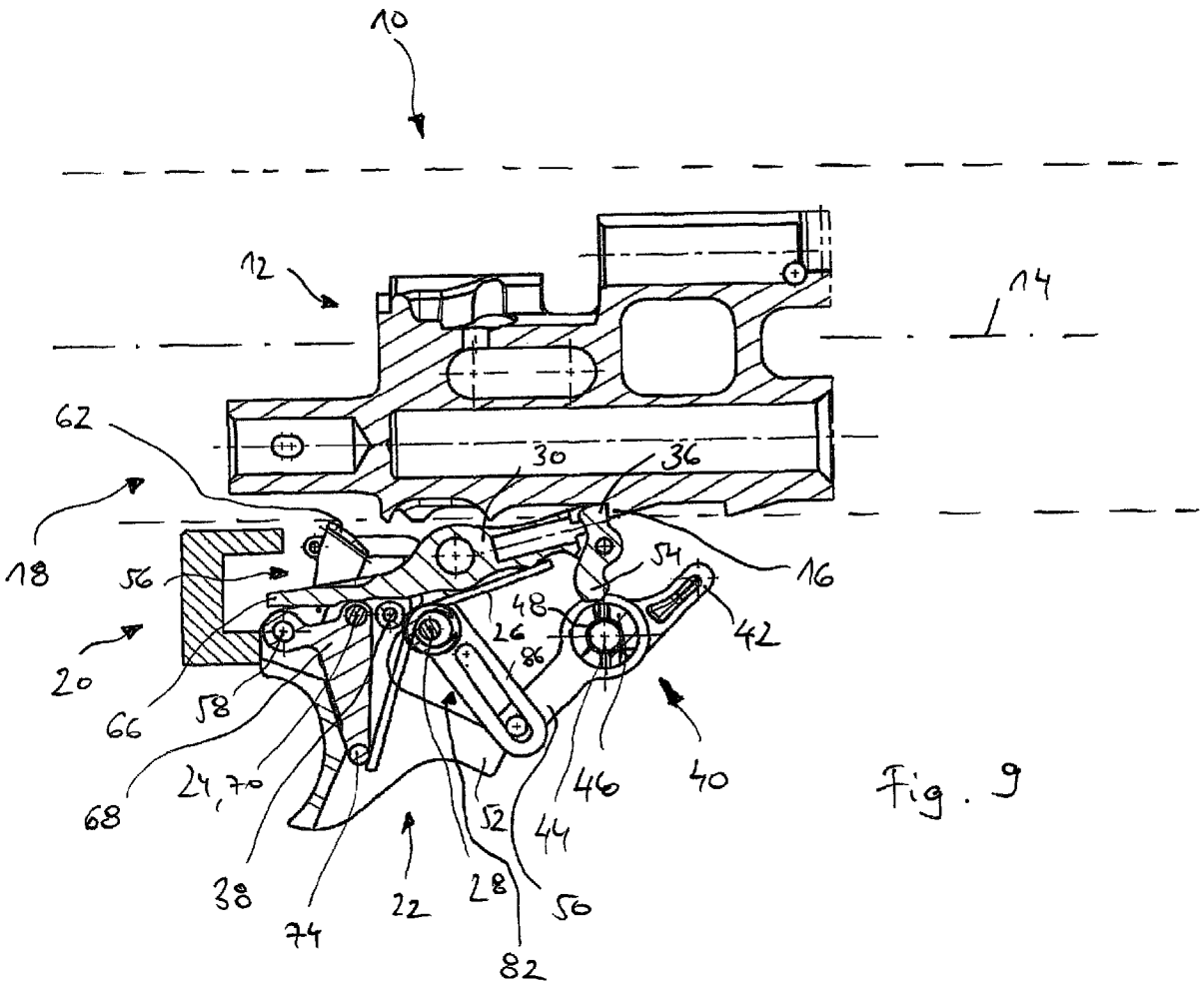
FIG. 9 is a view corresponding to FIG. 8, with the breechblock in the charging position after manipulation of the trigger assembly, securing and releasing again of the breechblock.

A trigger assembly 10 illustrated in FIGS. 8 and 9 has a construction similar to the trigger assembly 10 described above with reference to FIGS. 5 to 7. Therefore, reference will be made to the description of the trigger assembly 10 according to FIGS. 5 to 7 and also to the description of the trigger assembly 10 according to FIGS. 1 to 4 with regard to the construction and the method of operation of the trigger assembly 10 according to FIGS. 8 and 9.

In the trigger assembly 10 according to FIGS. 8 and 9, a safety element 82 is provided which can be pivoted about a safety-element pivoting axis 84. The safety-element pivoting axis 84 is secured to the grip piece. It is preferred if the safety-element pivoting axis 84 is formed by the transverse pin 28, which also serves for mounting the trigger spring 26.

The safety element 82 has a section 86 pointing from the safety-element pivoting axis 84 in the direction of the safety means 40, which section is coupled in terms of movement with the operating element 42 of the safety means 40 by means of a turning and sliding joint 88.

The safety element 82 further has a second section 90 pointing from the safety-element pivoting axis 84 in the direction of the release element 56, on which section an operative surface 92 which cooperates with the release element 56 is provided. The operative surface 92 is formed for example by a pin 94 extending parallel to the safety-element pivoting axis 84.

If the safety means 40 is in its unsecured position, the operative surface 92 of the safety element 82 is arranged approximately at the height of the stop 61 of the grip piece 20, so that the release element 56 (cf. FIG. 5) is pressed forwards. In the unsecured state of the safety means 40, a rotary joint 96 of the turning and sliding joint 88 is arranged closer to the safety-element pivoting axis 84 than in the secured state (illustrated in FIGS. 8 and 9). Transferring the operating lever 42 out of the unsecured state into the secured state is accompanied, under the action of the turning and sliding joint 88, by pivoting of the safety element 82, upon which the operative surface 92 of the safety element 82 moves substantially rearwards relative to the direction of firing and in so doing compulsorily transfers the release element 56 into a release position. This moves the contact section 66 of the catch lever 30 away from the catch projection 64 (cf. FIG. 5) of the release element 56, so that the catch lever 30 (supported by the trigger spring 26) is transferred into the catch position. As a result, a breechblock 12 is caught in an intermediate position or in a charging position illustrated in FIG. 9 by means of the safety pawl 36. As a result, even a manipulation of the trigger assembly 10 as described above with reference to FIGS. 3 and 4 does not result in the catch lever 30 adopting its resting position (and not its catch position) in the secured state of the safety means 40.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A trigger assembly for a firearm, the trigger assembly comprising:

a breechblock which is configured to be moved between a base position and a charging position:

a catch lever which is configured to be moved between a resting position for releasing the breechblock and a catch position for catching the breechblock;

a trigger element that is configured to be moved between a non-actuation position and an actuation position, in order to transfer the catch lever from the catch position into the resting position;

a release element that is configured to be moved relative to the trigger element, the release element being configured to be moved between a hold position for holding the catch lever in the resting position and a release position for releasing the catch lever in the catch position, wherein the release element is transferred from the hold position into the release position by contact of the breechblock with the release element, the breechblock contacts the release element while moving in the direction of the charging position;

wherein the release element is configured to be pivoted about a release-element pivoting axis, which is movable relative to the trigger element so that, even when the trigger is secured, the release element in the non-actuation position of the trigger element is configured to be moved out of a movement space of the breechblock is secured via the breechblock which moves in the direction of the base position; and wherein the release-element pivoting axis is disposed on an additional element which is separate from the release element and the trigger element, and wherein the additional element is mounted so as to be movable relative to the trigger element.

2. The trigger assembly according to claim 1, wherein the additional element is mounted in the trigger element so as to be pivotable about an additional-element pivoting axis.

3. The trigger assembly according to claim 2, wherein the release-element pivoting axis and the additional-element pivoting axis are parallel to one another.

4. The trigger assembly according to claim 1, wherein a safety, which in a secured state secures the catch lever in the catch position thereof and the trigger element in the non-actuation position thereof, and in an unsecured state permits transfer of the catch lever into the resting position thereof and transfer of the trigger element into the actuation position thereof.

5. The trigger assembly according to claim 1, wherein the safety has a safety element which is coupled in terms of movement with the release element such that transfer of the safety out of the unsecured state into the secured state is accompanied by transfer of the release element out of the hold position thereof into the release position.

6. The trigger assembly according to claim 5, wherein the safety element is configured to be pivoted about a safety-element pivoting axis.

7. The trigger assembly according to claim 6, wherein the safety-element pivoting axis is parallel to a bearing axis of a trigger spring which is configured to subject the catch lever to a spring force.

8. The trigger assembly according to claim 5, wherein the safety comprises an operating element, which is configured to be pivoted about an operating axis, so as to transfer the safety element into at least one of the secured or non-secured state thereof, and wherein the operating element and the safety element are coupled together in terms of movement via a turning and sliding joint.

9. A firearm, comprising:

a trigger assembly including:

a breechblock which is configured to be moved between a base position and a charging position;

a catch lever which is configured to be moved between a resting position for releasing the breechblock and a catch position for catching the breechblock;

a trigger element that is configured to be moved between a non-actuation position and an actuation position, in order to transfer the catch lever from the catch position into the resting position;

a release element that is configured to be moved relative to the trigger element, the release element being configured to be moved between a hold position for holding the catch lever in the resting position and a release position for releasing the catch lever in the catch position, wherein the release element is transferred from the hold position into the release position by contact of the breechblock with the release element, the breechblock contacts the release element while moving in the direction of the charging position;

wherein the release element is configured to be pivoted about a release-element pivoting axis, which is movable relative to the trigger element so that, even when the trigger is secured, the release element in the non-actuation position of the trigger element is configured to be moved out of a movement space of the breechblock is secured via the breechblock which moves in the direction of the base position; and wherein the release-element pivoting axis is disposed on an additional element which is separate from the release element and the trigger element, and wherein the additional element is mounted so as to be movable relative to the trigger element.

10. The trigger assembly according to claim 2, wherein a trigger-element pivoting axis and the additional-element pivoting axis are collinear with one another.

11. The trigger assembly according to claim 7, wherein the safety-element pivoting axis is colinear to a bearing axis of a trigger spring which is configured to subject the catch lever to a spring force.

12. The fire arm of claim 9, wherein the fire arm is a handgun.

* * * * *